US008597141B1

(12) United States Patent
Daniel

(10) Patent No.: US 8,597,141 B1
(45) Date of Patent: Dec. 3, 2013

(54) SMART GOLF TEE

(76) Inventor: Isaac S Daniel, Miramar, FL (US)

( * ) Notice: Subject to any disclaimer, the term of this patent is extended or adjusted under 35 U.S.C. 154(b) by 0 days.

(21) Appl. No.: 13/488,158

(22) Filed: Jun. 4, 2012

Related U.S. Application Data

(60) Provisional application No. 61/492,682, filed on Jun. 2, 2011.

(51) Int. Cl.
*A63B 57/00* (2006.01)

(52) U.S. Cl.
USPC ..... 473/400; 473/387

(58) Field of Classification Search
USPC ..... 473/132, 133, 155, 284, 387, 400
See application file for complete search history.

(56) References Cited

U.S. PATENT DOCUMENTS

| | | | | | |
|---|---|---|---|---|---|
| 1,846,407 | A * | 2/1932 | Thompson | ..... | 473/391 |
| 4,645,208 | A * | 2/1987 | Morabeto | ..... | 473/397 |
| 5,052,689 | A * | 10/1991 | Lettrich | ..... | 473/257 |
| 5,242,161 | A * | 9/1993 | Wilkirson | ..... | 473/386 |
| 5,679,081 | A * | 10/1997 | Santilli | ..... | 473/391 |
| 5,735,758 | A * | 4/1998 | Miketinac | ..... | 473/386 |
| 7,223,184 | B2 * | 5/2007 | Suwito | ..... | 473/386 |
| 7,717,811 | B1 * | 5/2010 | Merullo | ..... | 473/387 |
| 8,460,127 | B2 * | 6/2013 | Kumar | ..... | 473/396 |
| 2006/0100038 | A1 * | 5/2006 | Rose et al. | ..... | 473/387 |

* cited by examiner

*Primary Examiner* — Corbett B Coburn
(74) *Attorney, Agent, or Firm* — Albert Interian, III, Esq.

(57) ABSTRACT

A smart golf tee that includes a body having a ball receiving end and a ground insertion end, a processor joined to the body, at least one sensor connected to the processor, a communications means connected to the processor, and computer executable instructions readable by the processor and operative to use the at least one sensor to determine a ground insertion height of the body, and use the communications means to send an electronic communication related to the ground insertion height to a mobile device.

20 Claims, 8 Drawing Sheets

SMART GOLF TEE

FIELD

The present disclosure relates generally to electronic systems and sports equipment, and more specifically to smart and electronic golf tees.

PRIORITY INFORMATION

The present application is a non-provisional patent application based on U.S. provisional patent application Ser. No. 61/492,682, titled "Smart Golf Tee," filed on Jun. 2, 2011, by Isaac S. Daniel, to which the present application claims priority and whose disclosure is incorporate by reference as if fully stated herein.

BACKGROUND

Traditionally, it has been difficult for golfers to consistently and accurately set their tee height. Tee height is very important for tee shots, since the desired tee height may vary depending on the type of club and conditions on the course, such as wind, water hazards, dryness, height of grass, and the like.

Although there exists a variety of mechanical means for allowing users to determine golf tee height, they have been found to be cumbersome to use, and consistently using them has proven to be ineffective because they are easily lost or broken. Furthermore, current golf tees are not actively informative, and do not provide feedback to a user.

SUMMARY

The various embodiments of smart golf tees and smart golf tee systems described herein result from the realization that golf tees may be made more effective and useful by providing a smart and electronic golf tee that is capable of determining a golf tee insertion height, and communicating information or alerts related to the golf tee insertion height to users. Accordingly, such a smart golf tee would be able to inform a user of the golf tee or ground insertion height, provide wireless feedback to the user or user device to alert the user when a desired golf tee or ground insertion height has been achieved. A smart golf tee system also allows for user programmable settings for different clubs and/or conditions, as well as an easy power charging mechanism to allow the smart golf tee to be recharged.

Accordingly, the various embodiments and disclosures described herein solve the limitations of the prior art in a new and novel manner.

DETAILED DESCRIPTION OF PREFERRED EMBODIMENTS

Figure 1A:
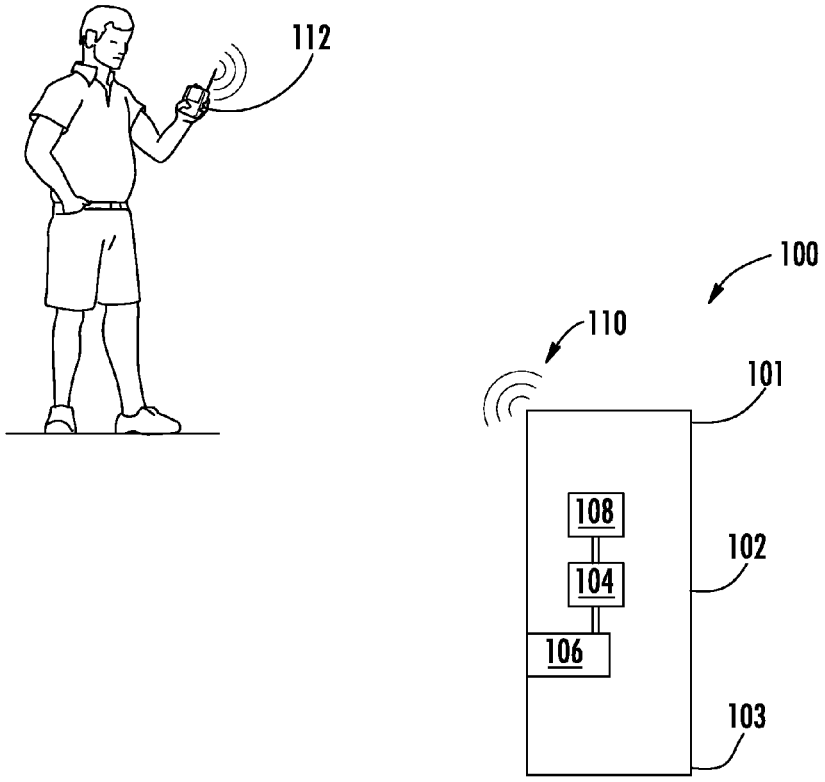
FIG. 1A shows a smart golf tee in accordance with one embodiment.

FIGS. 1A through 1E show a smart golf tee 100 in accordance with various embodiments, wherein tee 100 comprises a body 102 having a ball receiving end 101 and a ground insertion end 103, a processor 104 joined to body 102, at least one sensor 106 connected to processor 104, a communications means 108 connected to processor 104, and computer executable instructions readable by processor 104 and operative to use at least one sensor 106 to determine a ground insertion height (shown as 107, 107' in FIG. 1B) of body 102, and communications means 108 to transmit an electronic communication 110 related to the ground insertion height to a mobile device 112.

The terms "connected," "electronically connected," "electronic connection," "connection," "communication," and the like, when used in the context of electronic devices and systems, and the like, as used throughout the present disclosure, are intended to describe any type of electronic connection or electronic communication, such as, but not limited to, a physically connected or wired electronic connection and/or a wireless electronic connection, such as a direct connection, a connection through a network, or through wireless communications protocol such as a wireless local area network (WLAN), Bluetooth®, Zigbee®, and the like.

Body 102 may be formed in the shape of a conventional golf tee (as shown in FIGS. 1B through 1E), or may be formed in the shape of an unconventional golf tee to accommodate the various electronic components described herein. Body 102 may be formed of a single piece, or of multiple pieces. Body 102 may be formed from any type of material, such as, but not limited to, plastic, resin, carbon fiber, metal, wood, polycarbonate, graphite, and the like. In a preferred embodiment, body 102 may be formed of a high-strength material that is capable of withstanding blows from a golf club and protect the various electrical components contained therein, such as a high-strength metals or metal alloys, such as, but not limited to, titanium, titanium alloys, and the like. In another embodiment, body 102 may be covered in a softer material, such as rubber, plastic, latex, and the like, so as to not damage a golf club that it may come in contact with. Body 102 may comprise a pointed (or bottom) end, which may be suitable for inserting into the ground, such as ground insertion end 103, and a receiving (or top) end for receiving a golf ball, such as ball receiving end 101. In yet another embodiment, body 102 may comprise a plurality of cavities or apertures which may accommodate the various electronic components described herein. Body 102 may be formed or molded around said electronic components.

Processor 104 may be any type of processor, such as, but not limited to, a central processing unit (CPU), a microprocessor, a video processor, a front end processor, a coprocessor, a single-core processor, a multi-core processor, and the like. The computer executable instructions may be any type of computer executable instructions, which may be in the form of a computer program, the program being composed in any suitable programming language or source code, such as C++, C, C*, JAVA, JavaScript, HTML, XML, and other programming languages. Computer executable instructions may be stored locally, such as in a storage means or storage module positioned in body 102, or may be stored remotely, such in a mobile device 112 or a PC that is in communication with processor 104. The computer executable instructions may comprise an application running on mobile device 112, as well as firmware running on smart golf tee 100, wherein the application running on mobile device 112 may communicate with the firmware running on smart golf tee 100 in order to facilitate the various functions of smart golf tee 100.

Figure 1B:
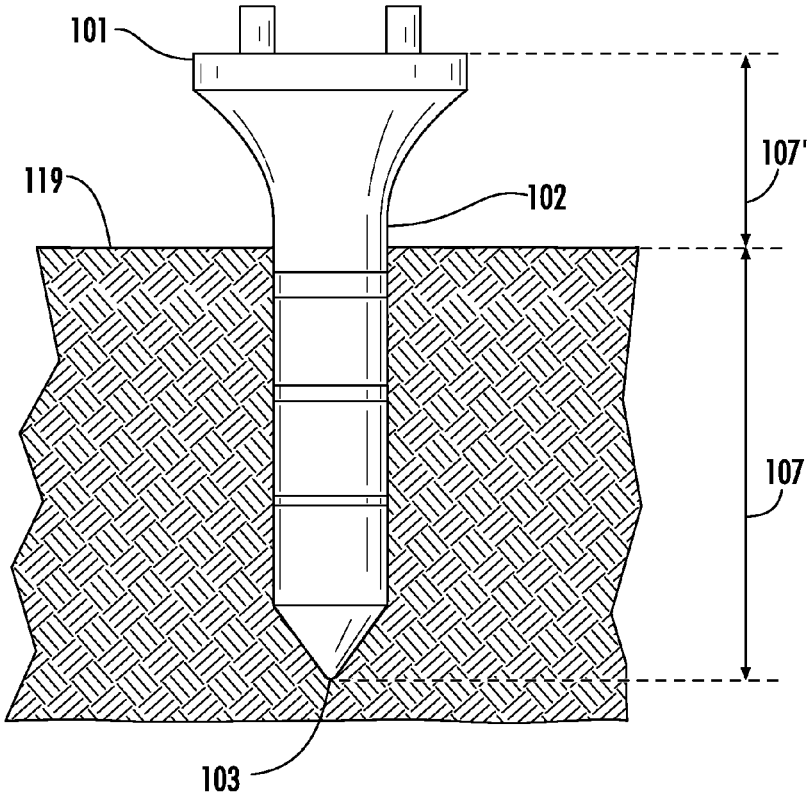
FIG. 1B shows a smart golf tee in accordance with another embodiment.

In some embodiments, at least one sensor 106 may be any type of sensor, such as a light sensor, a proximity sensor, a temperature sensor, a thermal conductivity sensor, an electrical conductivity sensor, a chemical sensor, a pressure sensor, and the like. At least one sensor 106 may be any type of sensor capable of determining when it has been submerged at or below ground level, and consequently the ground insertion height. The term "ground insertion height," as used herein and as shown in FIG. 1B, may refer to a distance 107' between a surface of ground 119 and the top or ball receiving end 101 of body 102, once body 102 has been partially or fully inserted into the ground 119. Alternatively, the term "ground insertion height" may refer to a distance 107 between the surface of ground 119 and the ground insertion end 103 of body 102.

In some embodiments, using at least one sensor 106 to determine a ground insertion height 107, 107' of body 102 comprises determining a ground insertion height 107, 107' based on whether at least one sensor 106 senses the ground at or near at least one sensor 106. In another embodiment, using at least one sensor 106 to determine a ground insertion height 107, 107' of body 102 comprises determining a ground insertion height 107, 107' based on whether at least one sensor 106 senses whether sensor 106 is under ground or at ground level. Ground insertion height 107, 107' may be calculated by subtracting the distance between sensor 106 and either the ball receiving end 101 or the ground insertion end 103 from the total length of body 102.

In a preferred embodiment, smart golf tee 100 comprises a plurality of at least one sensors 106 disposed along a length of body 102, thereby allowing sensing to occur at multiple, and preferably continuous points along body 102.

In some embodiments, at least one communications means 108 may comprise any type of communications means, such as electronic communications means, including, but not limited to, wireless communications means, such as wireless communications modules, including, but not limited to, Bluetooth®, WiFi®, Zigbee®, WLAN, and other wireless or radio frequency communications means. Accordingly, communications means 108 may comprise an antenna, which may be positioned at or near surface of body 102, and connected to processor 104. The antenna may be positioned on or near the ball receiving end 101, since it nearly always remains above ground and thus able to transmit information. In some embodiments, communications means 108 may be operative to communicate with mobile device 112 and transmit data to mobile device 112.

In yet another embodiment communications means 108 may comprise a wired communications means, such as a communications port, which may be used to transmit data to a separate device, such as a personal computer, tablet computer, or mobile computing device, such as mobile device 112.

In one embodiment, using one communications means 108 to send an electronic communication 110 related to the ground insertion height 107, 107' to at least one mobile device 112 may comprise wirelessly sending an electronic communication related to the ground insertion height 107, 107' to mobile device 112, which may include at least one user's mobile computing device, PC, tablet PC, smart phone, and the like. The electronic communication related to the ground insertion height 107, 107' may comprise data related to the ground insertion height 107, 107', such as the actual, sensed, calculated, or estimated ground insertion height 107, 107' (measured or presented in units of length, such as centimeters, inches, millimeters and the like), whether or not a particular, desired, pre-set, or user selected ground insertion height has been met, has been exceeded, or has yet to be reached, and other data related to the ground insertion height 107, 107'. In one embodiment, using communications means 108 to send an electronic communication 110 related to ground insertion height 107, 107' may comprise transmitting an alert when body 102 has been inserted to a predetermined ground insertion height. The alert may be presented as an audible alert, a visual alert, or an audio/visual alert, wherein the alert may be presented on mobile device 112, or through an alert means, such as a speaker or light positioned on body 102.

Figure 1C:
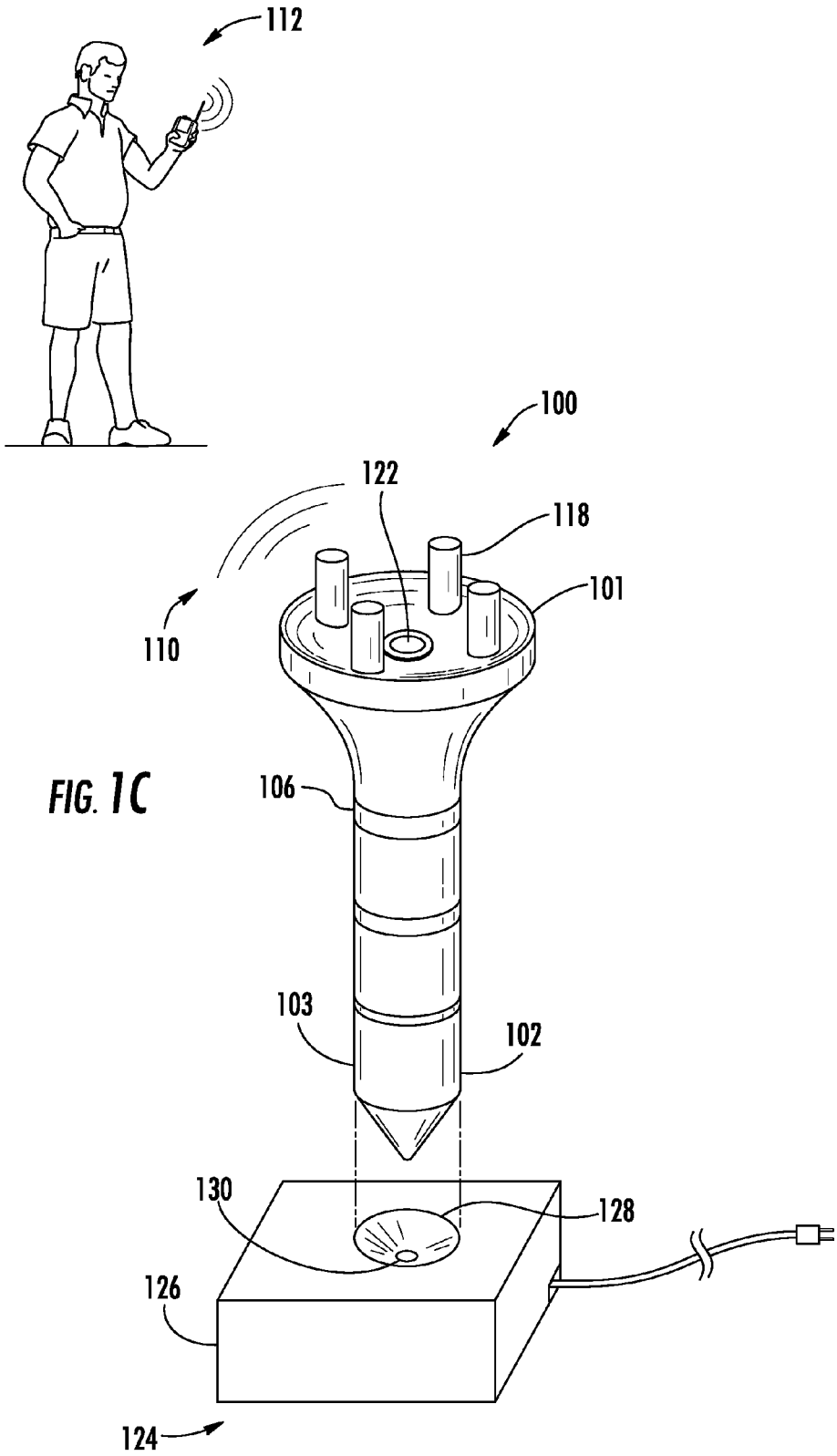
FIG. 1C shows a smart golf tee in accordance with another embodiment.
Figure 1D:
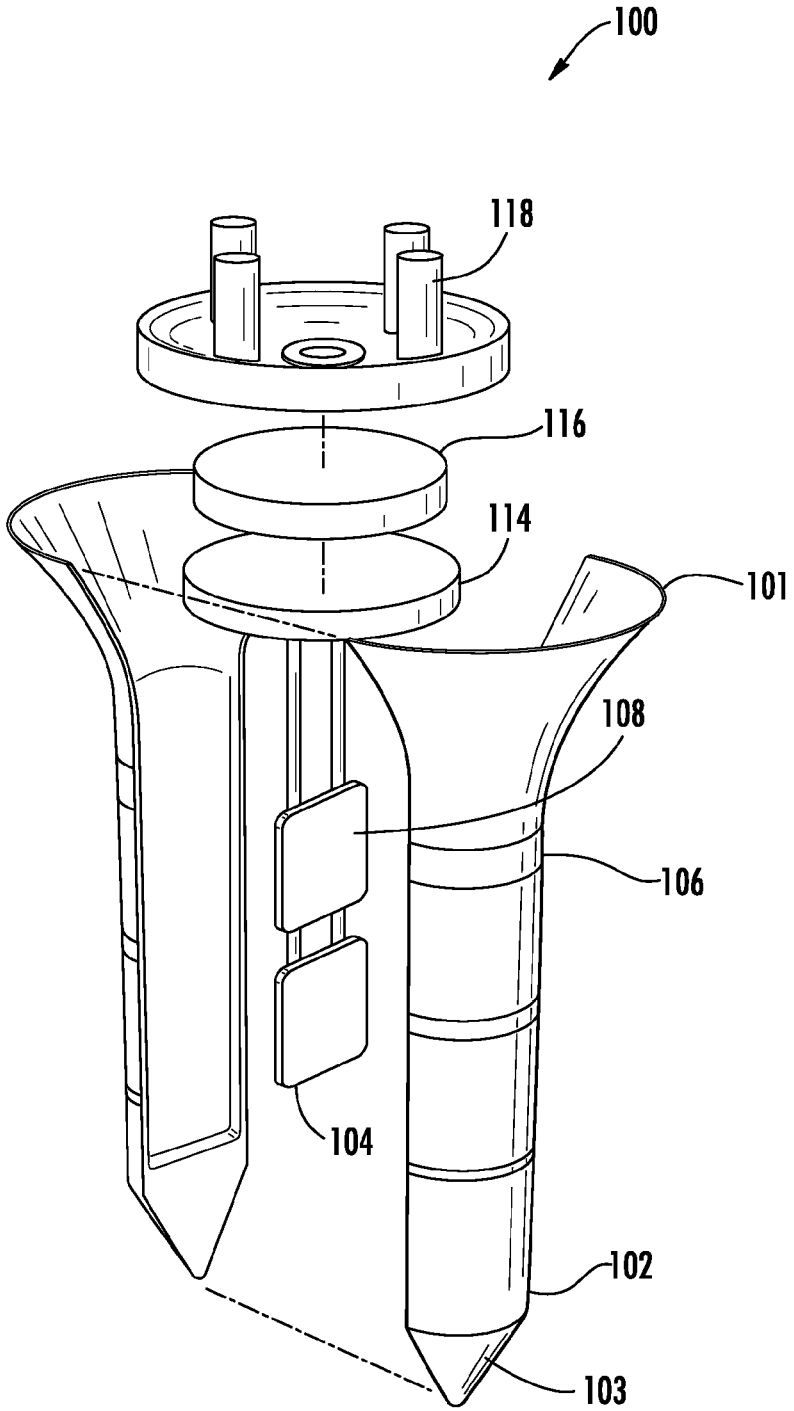
FIG. 1D shows an exploded view of a smart golf tee in accordance with one embodiment.
Figure 1E:
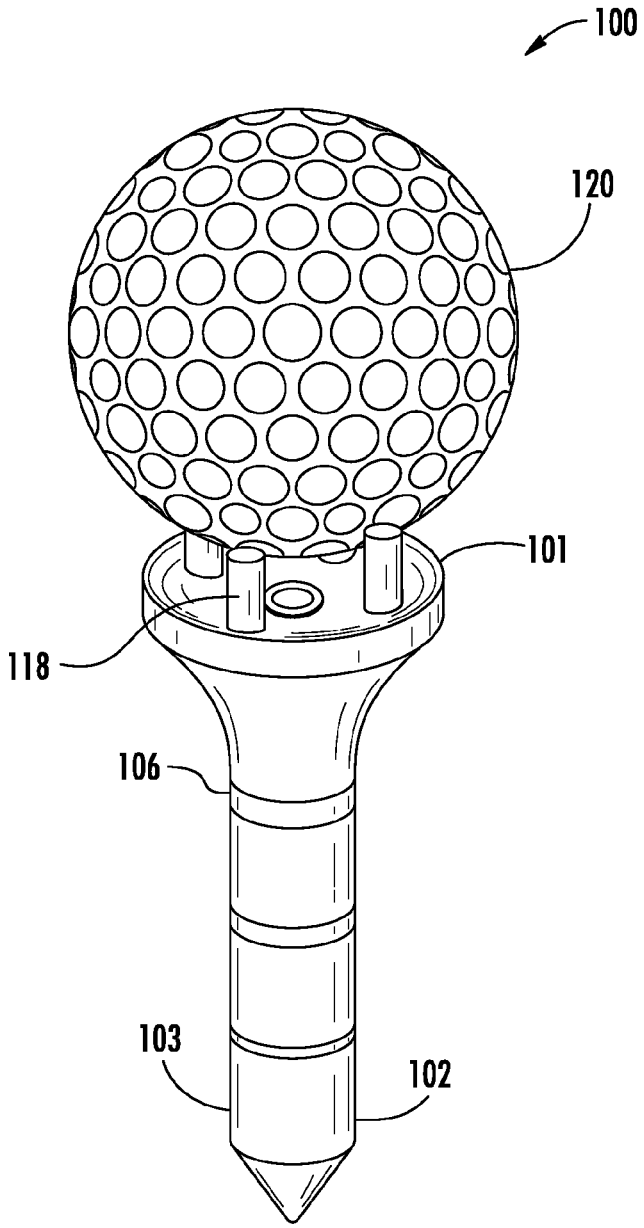
FIG. 1E shows a smart golf tee holding a golf ball in accordance with one embodiment.

In some embodiments, smart golf tee 100 further comprises at least one means 114 for receiving a power supply 116, wherein means 115 for receiving a power supply 116 may be connected to at least one processor 104. In some embodiments, means 114 for receiving a power supply may be used to power the electronic components comprising smart golf tee 100, such as processor 104, communications means 108 and/or at least one sensor 106. In one embodiment, means 114 for receiving a power supply 116 may comprise a port, a battery terminal, electrical contacts, and the like. Power supply 116 may comprise an internal power supply, such as a battery, or an external power supply, which may include a battery charger. Means 114 for receiving power supply 116 may be operative to be inserted in a charging station 124 (as shown in FIG. 1C), which may comprise a charging base 126 with at least one aperture 128 to receive means for receiving power supply 114. The charging base may comprise at least one (or a plurality of) aperture(s) capable of receiving body 102, wherein said apertures may have at least one electrical contact 130 disposed therein that may be operative to make contact with means for receiving power 114 on body 102, and thus transfer power to smart golf tee 100, which may include recharging a battery positioned in smart golf tee 100.

In yet another embodiment smart golf tee 100 may comprise at least one means for storing computer executable instructions, wherein the means for storing computer executable instructions may be connected to at least one processor 104. Means for strong computer executable instructions may comprise a storage module, such as a hard drive, memory, and the like. In one embodiment, data collected by or transmitted to the smart golf tee may be stored in the means for storing computer executable instructions, such as golf tee height settings, condition settings, previous recordings taken by sensor 106, commands received from at least one user via mobile device 112, programmed settings received from at least one user via mobile device112, and video recordings taken by at least one camera connected to at least one processor 104. Accordingly, mobile device 112 may comprise an application that is operative to communicate with smart golf tee 100, processor 104, and receive information from processor 104 and present it to a user of mobile device 112, as well as receive user input and transmit the user input, which may include desired or selected ground insertion heights, to processor 104.

Smart golf tee 100 may further comprise at least one bristle support 118 at a top (or ball receiving end 101) of body 102. In some embodiments, smart golf tee 100 may comprise a plurality of bristle supports 118. Bristle support 118 may offer more stability or less friction when supporting a golf ball 120. Bristle supports 118 may be positioned in any form, shape, or pattern, including, but not limited to a square, rectangle, circle, oval, spiral, triangle, and the like. Bristle support 118 may be formed of any material, including, but not limited to, hair, plastic, metal, and the like. In embodiments where support bristles are used on smart tee 100, ground insertion height 107, 107' may be determined by taking the length of bristle support 118 into consideration.

In one embodiment, smart golf tee 100 may further comprise a camera positioned on body 102. In some embodiments, at least one sensor 106 may comprise a camera. The camera may be positioned anywhere in or on body 102. In a preferred embodiment, the camera is positioned near a top end, or ball receiving end 101, of body 102, so as to be able to capture a golfer who will or is striking a ball supported by smart golf tee 100 while smart golf tee is inserted into the ground (since the ball receiving end 101 remains above ground at nearly all times). Accordingly, in a preferred embodiment, the computer executable instructions may be further operative to use the camera to capture at least one image (including a video clip) of a golfer (such as user of mobile device 112) swinging a club at a ball being supported by tee 100. The at least one image may be stored in the means for storing computer executable instructions, and may be communicated to a user for review. Consequently, the computer executable instructions may be operative to use communications means 108 to transmit the at least one image to mobile device 112 to be viewed by at least one user of mobile device 112.

In yet another embodiment, smart golf tee 100 may further comprises at least one location determination means for determining a location of the smart golf tee, wherein the location determination means may be connected to at least one processor 104. In one embodiment, location determination means may comprise a global positioning system ("GPS") module, and/or a local positioning system module (such as Wi-Fi positioning, RFID positioning, and the like). Accordingly, the computer executable instructions may be operative to use communications means 108 to transmit the location of the smart golf tee to at least one user 112.

In a further embodiment, smart golf tee 100 may comprise at least one means 122 for powering on at least one processor 104 (and possibly the other electrical components as well), wherein at least one means 122 for powering at least one processor 104 may be connected to at least one processor 104. In some embodiments, at least one means 122 for powering on at least one processor 104 may comprise a user activated means for powering on at least one processor 104, such as a switch, a button, a user activate sensor, and the like. Alternatively, at least one means 122 for powering on at least one processor 104 may comprise an automatic means for powering on at least one processor, such as a means for detecting the presence of a golf ball 120, which may be positioned at a top (or ball receiving end 101) of body 102. In some embodiments, the means for detecting the presence of a golf ball 120, may comprise at least one sensor, which may be similar in nature to at least one sensor 106, as well as a pressure plate, and the like.

In some embodiments, the computer executable instructions may be operative to allow at least one user to program an insertion height, which may include programmed height settings, and the like. The computer executable instructions may be further operative to store such height settings and other settings as well. This may be advantageous in that the at least one user may be able to program settings, such as ground height, based on the type of club being used, the conditions being played in (i.e. type of grass, wind, humidity, dryness, and the like), so that a user may simply enter a condition (or numerous conditions), and the smart golf tee will already determine the appropriate ground insertion height given the user inputted conditions. Furthermore, once a user determine that a ground insertion height is proper given a particular set of conditions (which may be determined through empirical means), the computer executable instructions may be operative to allow the user to store the proper settings. Accordingly, user inputs may be received from mobile device 112 (via an application running on mobile device 112), or directly, via a user input means positioned on or in body 102 of smart golf tee 101 (such as a button, and the like).

In another embodiment, the computer executable instructions may be operative to use communications means 108 to communicate with mobile device 112, and transmit or receive information related to ground insertion height 107, 107' to or from mobile device 112. Mobile device 112 may comprise an application that presents information related to ground insertion height 107, 107' to a user of mobile device 112 (via a display device or other means), and may comprise a user input means for receiving user input to send commands to smart golf tee 100.

In another embodiment, the computer executable instructions may be operative to transmit an alert when body 102 has been inserted to a predetermined (or pre-selected) ground insertion height 107, 107'. Said alert may comprise an audio, visual, or audio/visual alert. Said alert may be electronically (and thus wirelessly) transmitted to mobile device 112 and presented through mobile device 112. In an alternate embodiment, said alert may be presented via an alert means positioned on or in body 102 of smart golf tee 102, such as a speaker, a light, or a tactile alert means, such as a vibrator.

Figure 2A:
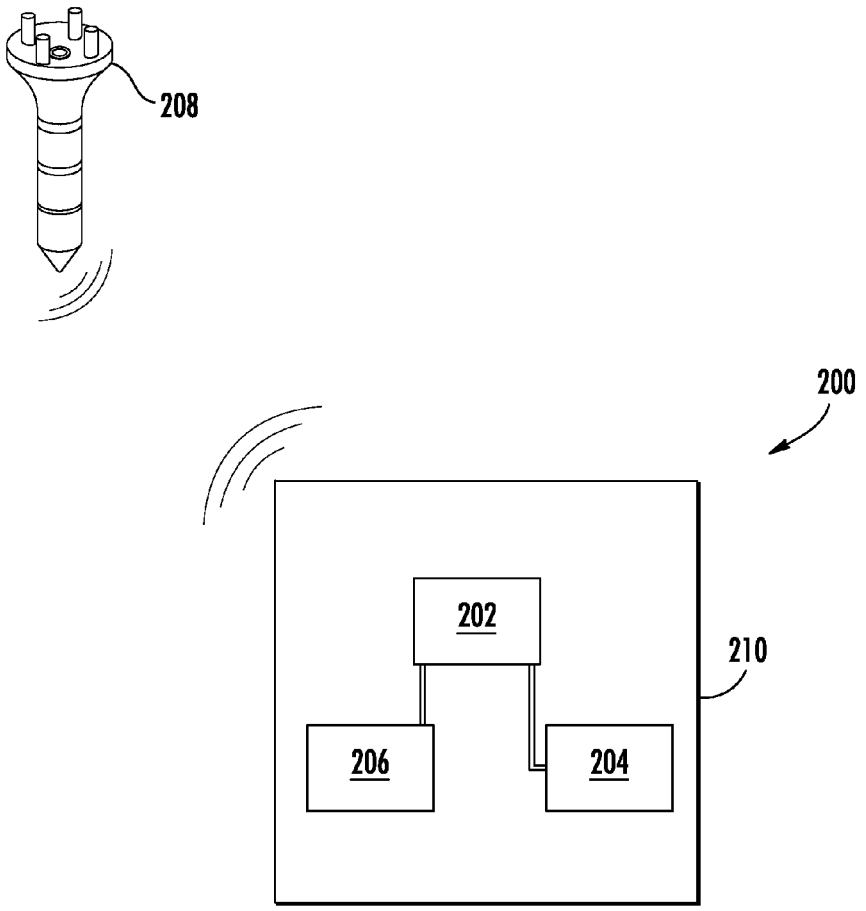
FIG. 2A shows a smart golf tee system in accordance with one embodiment.
Figure 2B:
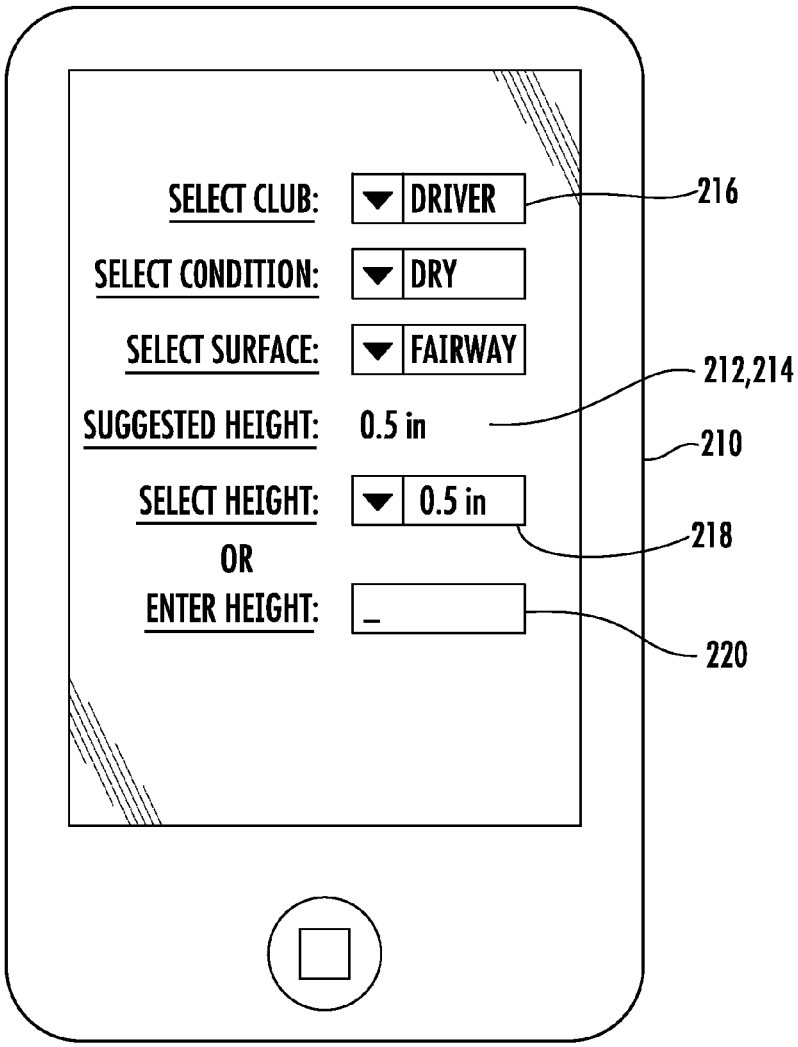
FIG. 2B shows a smart golf tee system in accordance with another embodiment.

Referring now to FIGS. 2A and 2B, a smart golf tee system 200 is shown in accordance with various embodiments, wherein system 200 comprises a processor 202, a communications means 204 connected to processor 202, a user input means 206 connected to processor 202, and computer executable instructions readable by processor 202 and operative to use user input means 206 to receive a user input related to a ground insertion height of a smart golf tee 208, use communications means 204 to transmit the user input to the smart golf tee 208, and use communications means 204 to receive information related to the ground insertion height of the smart golf tee 208 from the smart golf tee 208.

In some embodiments, processor 202 may be any type of processor, such as processor 104 and any other embodiments described above with reference to smart golf tee 100 and FIGS. 1A through 1E.

In some embodiments, communications means 204 may be any type of communications means, such as communications means 108 and any other embodiments described above with reference to smart golf tee 100 and FIGS. 1A through 1E.

User input means 206 may comprise any type of user input means, such as any of the embodiments described above with reference to smart golf tee 100 and FIGS. 1A through 1E, including, but not limited to, buttons, a keypad, a track pad, a voice-command system, a gesture recognition system, a touch screen, a virtual keyboard or buttons, and the like.

The computer executable instructions may be any of those embodiments described above with reference to smart golf tee 100 and FIGS. 1A through 1E. In another embodiment, the computer executable instructions may comprise an application 212 running on a mobile device 210 of which processor 202 may be a part. The application 212 may comprise a mobile application that may be downloaded to the mobile device 210. Accordingly, processor 202 may be part of mobile device 210.

In some embodiments, the user input related to a ground insertion height of a smart golf tee 208 may comprise any type of information related to a ground insertion height of a smart golf tee 208, such as the various embodiments described above with reference to smart golf tee 100 and FIGS. 1A through 1E, including, but not limited to, desired ground insertion height, a selected ground insertion height, a pre-selected ground insertion height, and the like.

The ground insertion height may be any of those embodiments described above with reference to FIGS. 1A through 1E, including the distance between a surface of the ground and a ball receiving end of a smart golf tee 208, or the distance between the surface of the ground and a ground insertion end of a smart golf tee 208. The surface of the ground may be detected and its level may be determined by using at least one sensor positioned on the smart golf tee 208.

In some embodiments, smart golf tee 208 may be any of those embodiments of smart golf tees described herein, such as smart golf tee 100 described above with reference to FIGS. 1A through 1E. In another embodiment, smart golf tee 208 may comprise at least one sensor to sense whether the sensor is at ground level or underground, and a communications means to transmit sensor collected information to processor 202.

Accordingly, in one embodiment, smart golf tee 208 may be a "dumb" smart golf tee since it may not be operative to process the data collected by its sensors, but instead relies on the computer executable instructions and processor 202, which may be external to smart golf tee 208.

In some embodiments, the computer executable instructions may comprise an application 212 running on a mobile device 210, as well as firmware running on smart golf tee 100, wherein the application 212 running on mobile device 210 may communicate with the firmware running on smart golf tee 208 in order to facilitate the various functions of the smart golf tee system 200.

In one embodiment, application 212 may comprise a graphical user interface 214 on a display wherein as user may input (or select from available options 216, such as drop down menus) various parameters, such as club selection, conditions (such as weather), surface (e.g. tee, fairway, rough, etc.), and/or suggested ground insertion heights which may be based thereon. In another embodiment, application 212 may comprise a graphical user interface on a display wherein users may enter a desired ground insertion height or choose from options of ground insertion heights. Accordingly, system 200 may comprise a display connected to processor 202, wherein the computer executable instructions may be operative to display at least one user-selectable ground insertion height 218 or a ground insertion height user input field 220.

Accordingly, the information related to the ground insertion height of smart golf tee 208 may comprise any of those various embodiments described herein and above with reference to FIGS. 1A through 1E, such as the ground insertion height as measured by the smart golf tee 208, an alert as to whether the smart golf tee 208 has been inserted to a desired ground insertion height, or an alert that the ground insertion height of the smart golf tee 208 has changed.

Figure 3:
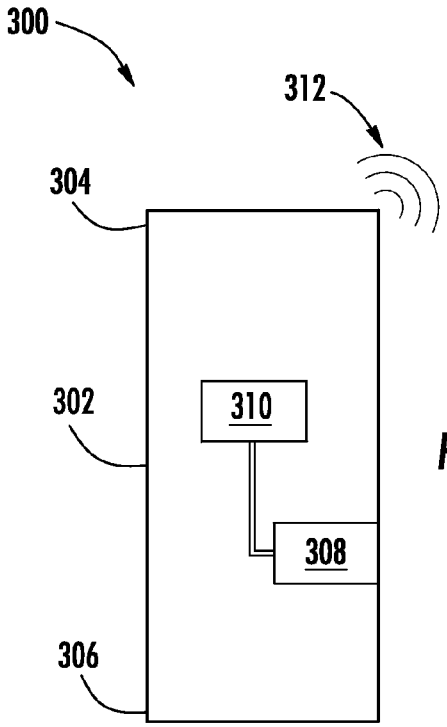
FIG. 3 shows a smart golf tee in accordance with yet another embodiment.

Referring now to FIG. 3, a smart golf tee 300 is shown in accordance with one embodiment, wherein smart golf tee 300 comprises a body 302 having a ball receiving end 304 and a ground insertion end 306, at least one sensor 308 positioned on or in body 302, wherein at least one sensor 308 may be operative to sense whether at least one sensor 308 is underground, and a processor 310 joined to body 302 and connected to at least one sensor 308, wherein processor 310 may be operative to transmit an alert 312 when at least one sensor 308 is underground.

In some embodiments, body 302 may be any type of body, such as those described above with reference to FIGS. 1A through 2B.

In some embodiments, at least one sensor 308 may be any type of sensor, including the various embodiments of sensors described above with reference to FIGS. 1A through 2B.

In some embodiments, processor 310 may be any type of processor, including the various embodiments of processors described above with reference to FIGS. 1A through 2B.

In some embodiments, alert 312 may any type of alert, including the various embodiments described above with reference to FIGS. 1A through 2B. In one embodiment, alert 112 may be electronically transmitted to a mobile device, which may then present the alert to a user in the form of an audio, visual, audio/visual, or tactile alert. The mobile device may be any of the various embodiments of mobile devices described above with reference to FIGS. 1A through 2B. Alert 112 may be transmitted to the mobile device by using a communications means disposed in body 302 and connected to processor 310, wherein the communications means may comprise any of the various embodiments described above with reference to FIGS. 1A through 1E. In an alternate embodiment, alert 112 may be presented directly by smart golf tee 300, such as being presented via an audio transmission device, such as a speaker, connected to body 302, or via a light transmission device, such as a light emitting diode or bulb, connected to body 302. The audio transmission device or light transmission device may be connected to and thus controlled by processor 310. In some embodiments, alert 112 may comprise an audio alert, a visual alert, a tactile alert, or any combination thereof, and the like.

In some embodiments, alert 112 may be transmitted to a dongle, fob, or wearable device, which then presents alert 112 to a user in the form of an audio, visual, audio/visual, or tactile alert, such as by using a speaker, a light, or a tactile feedback means, such as a vibrator.

Hardware and Operating Environment

This section provides an overview of exemplary hardware and the operating environments in conjunction with which embodiments of the inventive subject matter can be implemented.

A software program may be launched from a computer readable medium in a computer-based system to execute the functions defined in the software program. Various programming languages may be employed to create software programs designed to implement and perform the methods disclosed herein. The programs may be structured in an object-orientated format using an object-oriented language such as Java or C++. Alternatively the programs may be structured in a procedure-oriented format using a procedural language, such as assembly or C. The software components may communicate using a number of mechanisms, such as application program interfaces, or inter-process communication techniques, including remote procedure calls. The teachings of various embodiments are not limited to any particular programming language or environment. Thus, other embodiments may be realized, as discussed regarding FIG. 4 below.

Figure 4:
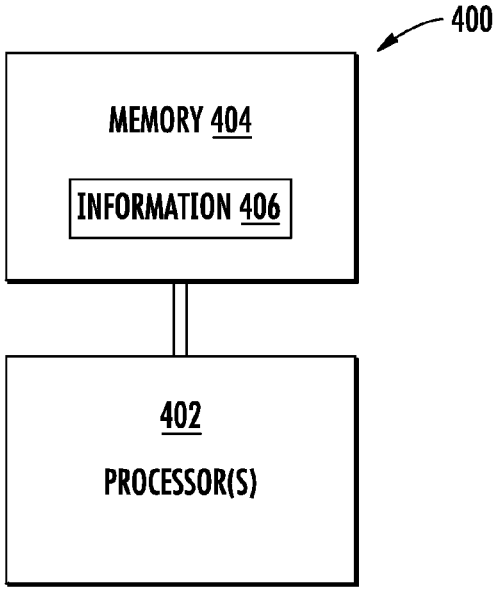
FIG. 4 shows a block diagram depicting an article in accordance with one embodiment.

FIG. 4 is a block diagram representing an article according to various embodiments. Such embodiments may comprise a computer, a memory system, a magnetic or optical disk, some other storage device, or any type of electronic device or system. The article 400 may include one or more processor(s)

402 coupled to a machine-accessible medium such as a memory 404 (e.g., a memory including electrical, optical, or electromagnetic elements). The medium may contain associated information 406 (e.g., computer program instructions, data, or both) which, when accessed, results in a machine (e.g., the processor(s) 402) performing the activities previously described herein.

The principles of the present disclosure may be applied to all types of computers, systems, and the like, include desktop computers, servers, notebook computers, personal digital assistants, microcomputers, and the like. However, the present disclosure may not be limited to the personal computer.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed is:

1. A smart golf tee comprising:
   a. a body having a ball receiving end and a ground insertion end;
   b. a processor joined to the body;
   c. at least one sensor connected to the processor;
   d. a communications means connected to the processor; and
   e. computer executable instructions readable by the processor and operative to:
      i. use the at least one sensor to determine a ground insertion height of the body; and
      ii. use the at least one communications means to transmit an electronic communication related to the ground insertion height to a mobile device.

2. The smart golf tee of claim 1, further comprising at least one means for receiving a power supply, wherein the means for receiving a power supply is connected to the processor.

3. The smart golf tee of claim 1, further comprising at least one bristle ball support positioned at the ball receiving end.

4. The smart golf tee of claim 1, further comprising a camera positioned on the body.

5. The smart golf tee of claim 4, wherein the computer executable instructions are further operative to use the camera to capture at least one image of a golfer swinging a club at a ball resting on the ball receiving end.

6. The smart golf tee of claim 5, wherein the computer executable instructions are further operative to use the communications means to transmit the at least one image to the mobile device.

7. The smart golf tee of claim 1, further comprising at least one location determination means for determining a location of the smart golf tee, wherein the location determination means is connected to the at least one processor.

8. The smart golf tee of claim 7, wherein the computer executable instructions are further operative to use the communications means to transmit the location to at least one user.

9. The smart golf tee of claim 1, further comprising at least one means for powering on the at least one processor, wherein the at least one means for powering on the at least one processor is connected to the at least one processor.

10. The smart golf tee of claim 9, wherein the means for powering on the at least one processor comprises a means for detecting the presence of a golf ball, wherein the means for detecting the presence of a golf ball is positioned at the ball receiving end.

11. The smart golf tee of claim 1, wherein the computer executable instructions are further operative to allow at least one user to program a ground insertion height.

12. The smart golf tee of claim 1, wherein the computer executable instructions are further operative to store settings.

13. The smart golf tee of claim 1, wherein the computer executable instructions are operative to use the communications means to communicate with a mobile device and transmit or receive information related to the ground insertion height to a mobile device.

14. The smart golf tee of claim 1, wherein the computer executable instructions are operative to transmit an alert when the body has been inserted to a predetermined ground insertion height.

15. A smart golf tee system comprising:
   a. a processor;
   b. a communications means connected to the processor;
   c. a user input means connected to the processor; and
   d. computer executable instructions readable by the processor and operative to:
      i. use the user input means to receive a user input related to a ground insertion height of a smart golf tee;
      ii. use the communications means to transmit the user input to the smart golf tee; and
      iii. use the communications means to receive information related to the ground insertion height of the smart golf tee from the smart golf tee.

16. The system of claim 15, wherein the processor is part of a mobile device.

17. The system of claim 15, wherein the user input related to a ground insertion height of a smart golf tee comprises a desired ground insertion height.

18. The system of claim 15, wherein the information related to the ground insertion height of the smart golf tee comprises the ground insertion height as measured by the smart golf tee, an alert as to whether the smart golf tee has been inserted to a desired ground insertion height, or an alert that the ground insertion height of the smart golf tee has changed.

19. The system of claim 15, comprising a display connected to the processor, wherein the computer executable instructions are operative to use the display to display at least one user-selectable ground insertion height or a ground insertion height user input field.

20. A smart golf tee comprising:
   a. a body having a ball receiving end and a ground insertion end;
   b. at least one sensor positioned on or in the body, wherein the at least one sensor is operative to sense whether the at least one sensor is underground; and
   c. a processor joined to the body and connected to the at least one sensor, wherein the processor is operative to transmit an alert when the at least one sensor is underground.

* * * * *